US005766737A

United States Patent [19]

Willey et al.

[11] Patent Number: 5,766,737

[45] Date of Patent: Jun. 16, 1998

[54] NONWOVEN FABRICS HAVING DIFFERENTIAL AESTHETIC PROPERTIES AND PROCESSES FOR PRODUCING THE SAME

[75] Inventors: Jacqueline A. Willey, Mauldin; Deborah K. Lickfield, Easley, both of S.C.

[73] Assignee: Fiberweb North America, Inc., Simpsonville, S.C.

[21] Appl. No.: 685,349

[22] Filed: Jul. 23, 1996

[51] Int. Cl.[6] ..... B32B 27/14

[52] U.S. Cl. ..... 428/198; 128/849; 156/290; 428/212; 428/903; 442/340

[58] Field of Search ..... 428/198, 212, 428/903; 442/340, 373, 382, 400, 401; 156/290; 128/849

[56] References Cited

U.S. PATENT DOCUMENTS 4,041,203 8/1977 Brock et al. .
4,196,245 4/1980 Kitson et al. .
4,863,785 9/1989 Berman et al. .

*Primary Examiner*—James J. Bell
*Attorney, Agent, or Firm*—Bell Seltzer Intellectual Property Law Group of Alston & Bird LLP

[57] ABSTRACT

The invention is directed to composite nonwoven laminate fabric having differential softness and flexibility properties. The nonwoven laminate fabric includes a polypropylene meltblown web sandwiched between and bonded to a spunbonded web of polypropylene filaments and a spunbonded web of polyethylene filaments.

17 Claims, 1 Drawing Sheet

NONWOVEN FABRICS HAVING DIFFERENTIAL AESTHETIC PROPERTIES AND PROCESSES FOR PRODUCING THE SAME

FIELD OF THE INVENTION

The invention relates to nonwoven fabrics and to processes for producing nonwoven fabrics. More specifically, the invention relates to nonwoven barrier fabrics particularly suited for medical applications.

BACKGROUND OF THE INVENTION

Nonwoven barrier fabrics have been developed which impede the passage of bacteria and other contaminants and which are used for disposable medical fabrics, such as surgical drapes, disposable gowns and the like. Barrier fabrics can be formed by sandwiching an inner fibrous web of thermoplastic meltblown microfibers between two outer nonwoven webs of substantially continuous thermoplastic spunbonded filaments. The fibrous meltblown web provides a barrier impervious to bacteria or other contaminants in the composite nonwoven fabric. The outer spunbonded webs are selected to provide abrasion resistance and strength to the composite fabric. Examples of such trilaminate nonwoven fabrics are described in U.S. Pat. No. 4,041,203 and U.S. Pat. No. 4,863,785.

Conventional barrier fabrics can be limited with regard to the aesthetic properties thereof, such as fabric drapeability, flexibility, and softness. For example, typically, each of the fabric layers of a trilaminate barrier nonwoven fabric is formed of polypropylene, which can provide good strength and abrasion resistant properties to the fabric, but suffers from aesthetic drawbacks, such as stiffness, harshness to touch, and the like.

In addition, it can be advantageous for trilaminate nonwoven barrier fabrics to have fluid repellent characteristics, particularly for fabrics used for surgical items, such as surgical drapes and surgical gowns. It is often desirable to incorporate a hydrophobic nonwoven web as a liquid impermeable layer in a nonwoven composite to prevent fluids from penetrating the nonwoven fabric and reaching the wearer's skin. However, material used to manufacture hydrophobic webs typically have a poor hand or feel, and thus such webs can suffer from poor fabric aesthetics.

To improve the aesthetics of trilaminate fabrics without compromising strength and fluid repellency properties, bicomponent fibers and blend fibers have been used to manufacture individual components of a trilaminate fabric. The constituent polymers of bicomponent and blend fibers can be selected to impart the desired properties to the fibers, and to the fabrics made therefrom. Fabrics which include as a component thereof a web formed of biconstituent fibers or blend fibers can have improved aesthetics and other properties. However, the use of bicomponent and/or blend fibers requires more complex equipment than required for homofilaments, and can also require additional processing steps. In addition, such equipment can be expensive to operate.

SUMMARY OF THE INVENTION

The invention provides composite nonwoven fabrics having desirable barrier properties, fluid repellency, and/or aesthetics in one fabric. The nonwoven fabrics of the invention include an outer nonwoven web formed of spunbonded substantially continuous thermoplastic filaments and a nonwoven web of thermoplastic meltblown microfibers sandwiched between and bonded to the spunbonded webs. The filaments of the outer spunbonded webs are formed of polymers having differential aesthetic properties. As a result, each of the spunbonded webs have differential softness, flexibility, etc., and thus impart to the composite fabric differential aesthetic properties.

In one preferred embodiment, the composite fabric of the invention includes a nonwoven web formed of spunbonded substantially continuous polypropylene filaments, a nonwoven web formed of spunbonded substantially continuous polyethylene filaments, and a nonwoven web of polypropylene meltblown microfibers sandwiched between and bonded to the spunbonded webs. All of the layers are preferably thermally bonded together via a plurality of discrete thermal bonds distributed substantially throughout and the length and width dimensions of the composite nonwoven fabric.

The composite nonwoven fabrics of the invention have excellent barrier properties, are flexible and soft, and provide desirable fluid repellency properties. The laminate fabrics of the invention can be used as components on any variety of nonwoven products, and are particularly useful as barrier components in medical fabrics, such as sterile wraps, surgical gowns, surgical drapes, and the like. The spunbonded web of polypropylene continuous filaments provides good abrasion resistance and strength to the laminate fabric of the invention. The inner polypropylene meltblown layer provides good barrier properties. The polyethylene spunbonded fabric provides desirable aesthetic properties to the laminate fabric, such as improved flexibility and softness.

In another aspect of the invention, medical fabrics which include the laminate polypropylene spunbonded-polypropylene meltblown-polyethylene spunbonded composite fabric described above are also provided. In particular, the composite nonwoven fabrics of the invention are useful as components in medical fabrics such as surgical drapes and gowns. For example, when used to form a surgical gown, the polyethylene spunbonded fabric layer is an inner layer of the surgical fabric, i.e., is adjacent the wearer's skin. Accordingly, the surgical gowns of the invention provide a comfortable texture to a fluid repellent, barrier composite fabric. In addition, by incorporating an inner polyethylene spunbonded fabric, the surgical fabric of the invention exhibits improved flexibility and drape, which is useful for conformability about body parts in a surgical gown, or for drapeability of a draped fabric used in an operating room.

Nonwoven laminate fabrics according to the invention can be readily manufactured according to another aspect of the invention. The nonwoven laminate fabrics may be manufactured by forming a layered web including a nonwoven web of polypropylene meltblown microfibers sandwiched between a spunbonded web of polypropylene filaments and a spunbonded web of polyethylene filaments. Thereafter, the layers of the resultant composite nonwoven fabric are subjected to a thermal bonding treatment sufficient to provide a plurality of discrete thermal bonds distributed substantially throughout the fabric surface. Advantageously, the composite fabric is bonded using an embossing calendar.

The laminate nonwoven fabric of the invention provides several desirable and yet apparently opposing properties in one fabric. The fabrics of the invention not only provide a barrier to the transmission of fluids, bacteria and other contaminants and fluid repellency; they also provide desirable aesthetics such as a cloth-like feel and drapeability without the diminishment of the barrier and fluid repellency characteristics.

BRIEF DESCRIPTION OF THE DRAWINGS

In the drawings which form a portion of the original disclosure of the invention.

DETAILED DESCRIPTION OF THE INVENTION

The present invention will now be described more thoroughly hereinafter with reference to the accompanying drawings, in which illustrative embodiments of the invention are shown. This invention may, however, be embodied in many different forms and should not be construed as limited to the embodiments set forth herein. Rather, this embodiment is provided so that the disclosure will be thorough and complete, and will convey fully the scope of the invention to those skilled in the art. Like numbers refer to like elements throughout. For purposes of clarity, the scale has been exaggerated.

Figure 1:
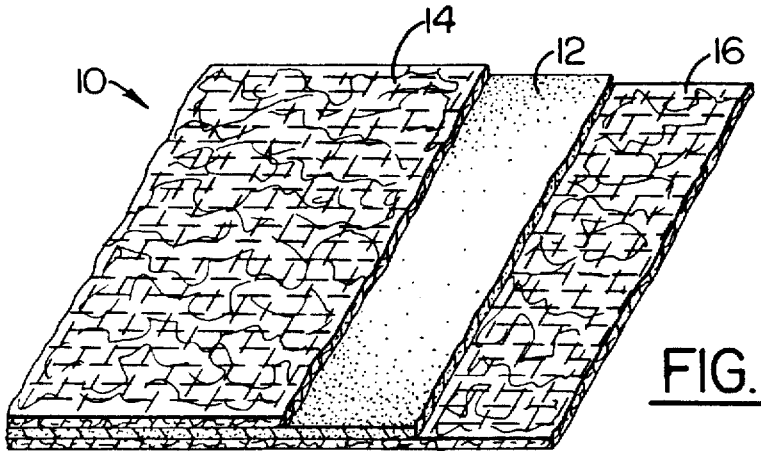
FIG. 1 is a fragmentary top view of a laminate nonwoven fabric in accordance with the invention, partially cut away to illustrate the component layers thereof.

FIG. 1 is a fragmentary top view of a laminate fabric in accordance with the present invention. The laminate is designated generally as 10. Laminate fabric 10 is partially cut away to illustrate the individual components thereof. The fabric is a three ply composite comprising an inner ply 12 sandwiched between outer plies 14 and 16. The composite fabric 10 has good strength, flexibility and drape and may be formed into various articles or garments such as sterile wraps, surgical gowns, surgical drapes and the like. The barrier properties of the fabric 10 make it particularly suitable for medical applications, but the fabric is also useful for any other applications wherein a barrier to contaminants and fluid repellency, as well as a cloth-like feel and drapeability, would be desirable, such as industrial garments, filtration media, and disposable wipes.

Inner-ply 12 is a nonwoven fibrous web comprising a plurality of meltblown thermoplastic meltblown microfibers. The microfibers can be made of any of a number of known fiber forming polymer compositions. Such polymers include those selected from the group consisting of polyolefins such as polypropylene and polyethylene, polyesters, polyamides, and copolymers and blends thereof. Preferably, the microfibers are polypropylene microfibers.

The microfibers preferably have an average fiber diameter of up to about 10 microns with very few, if any, other fibers exceeding 10 microns in diameter. Typically, the average diameter of the fibers will range from 2 to 6 microns. The meltblown microfibrous layer 12 is preferably manufactured in accordance with the process described in Buntin et al., U.S. Pat. No. 3,978,185. The meltblown layer 12 can have a basis weight in the range of about 10 to about 80 grams per square meter (gsm), and preferably in the range of about 10 to 30 gsm.

Advantageously, meltblown web 12 is electrically treated to improve filtration properties of the web. Such electrically treated fibers are known generally in the art as "electret" fibrous webs. Electret fibrous filters are highly efficient in filtering air because of the combination of mechanical entrapment of particles in the air with the trapping of particles based on the electrical or electrostatic characteristics of the fibers. Both charged and uncharged particles in the air, of a size that would not be mechanically trapped by the filtration medium, will be trapped by the charged nature of the filtration media. Meltblown web 12 can be electrically treated using techniques and apparatus known in the art. Alternatively, the laminate fabric of the invention 10 can be electrically treated using conventional techniques after respective layers 12, 14, and 16 have been assembled to form laminate fabric 10.

Outer ply 14 of the laminate fabric 10 is a nonwoven web of spunbonded substantially continuous thermoplastic filaments. The thermoplastic filaments of ply 14 can be made of any of a number of known fiber forming polymer compositions. Such polymers include those selected from the group consisting of polyolefins such as polypropylene and polyethylene, polyesters, polyamides, and copolymers and blends thereof. Spunbonded web 14 may be produced using well-known spunbonding processes, and may suitably have a basis weight in the range of about 10 gsm to about 100 gsm.

Outer ply 16 of the laminate fabric 10 is also a nonwoven web of spunbonded substantially continuous thermoplastic filaments. As with spunbonded ply 14, the filaments of ply 16 can be made of any of a number of known fiber forming polymer compositions, including polyolefins such as polypropylene and polyethylene, polyesters, polyamides, and copolymers and blends thereof. However, the filaments of ply 16 are formed of a polymer selected to provide differential aesthetic properties to ply 16 as compared to ply 14, i.e., different softness, flexibility, drapeability, and the like. Preferably, the filaments of ply 16 are formed of a polymer which imparts greater softness and flexibility thereto as compared to ply 14.

In this regard, advantageously, ply 16 exhibits at least about 25%, and preferably at least about 50% increase in softness and flexibility as compared to ply 14, as determined using conventional testing procedures such as IST90.3-92. The flexibility and softness differential between plies 14 and 16 translates into improved softness and flexibility of the resultant laminate, as compared to conventional polypropylene spunbonded/polypropylene meltblown/polypropylene spunbonded trilaminate fabrics of substantially the same basis weight and bond pattern. Specifically, the laminate fabrics of the invention exhibit at least about 25% and, preferably at least about 40%, or greater, increase in softness and flexibility over conventional polypropylene trilaminate fabrics.

In a preferred embodiment of the invention, ply 14 is a polypropylene spunbonded web and ply 16 is a polyethylene spunbonded web, although each of ply 14 and ply 16 can be formed of other polymers as described above, so long as the resultant plies exhibit differential aesthetic properties.

The term "polyethylene" is used herein in a general sense, and is intended to include various homopolymers, copolymers, and terpolymers of ethylene, including low density polyethylene, high density polyethylene, and linear low density polyethylene, with high density polyethylene ("HDPE") being the most preferred.

Spunbonded web 16 may be produced using well-known spunbonded processes and may have a basis weight in the range described above with regard to spunbonded web 14. Advantageously, spunbonded web 16 has a basis weight similar to spunbonded web 14.

Layers 12, 14 and 16 of the laminate fabric of the present invention can be bonded together to form a coherent fabric using techniques and apparatus known in the art. For example, layer 12, 14 and 16 can be bonded together by thermal bonding, mechanical interlocking, adhesive bonding, and the like. Preferably, laminate fabric 10 includes a multiplicity of discrete thermal bonds distributed throughout the fabric, bonding layers 12, 14 and 16 together to form a coherent fabric.

In addition, as will be appreciated by the skilled artisan, laminate fabric 10 can include one or more additional layers to provide improved barriers to transmission of liquids, airborne contaminates, etc. and/or additional supporting layers.

Laminate fabric 10 of the invention exhibits a variety of desirable characteristics, which makes the fabric particularly useful as a barrier fabric in medical applications. At least one spunbonded layer is formed of a polymer selected to provide good strength and abrasion resistance to the laminate, preferably polypropylene. The other of the spunbonded webs is formed of a polymer selected to impart desirable aesthetic properties to the web, and thus to the resultant laminate fabric. The other of the spunbonded webs has increased softness and flexibility, and is preferably is a polyethylene spunbonded web. The meltblown inner web provides good barrier properties, and preferably is a polypropylene meltblown web. The resultant fabric can exhibit significantly improved aesthetic properties such as a soft hand or feel, improved drape and flexibility, as compared to currently available commercial products. Yet the fabric also maintains good barrier properties, as well as fluid repellency.

Figure 2:
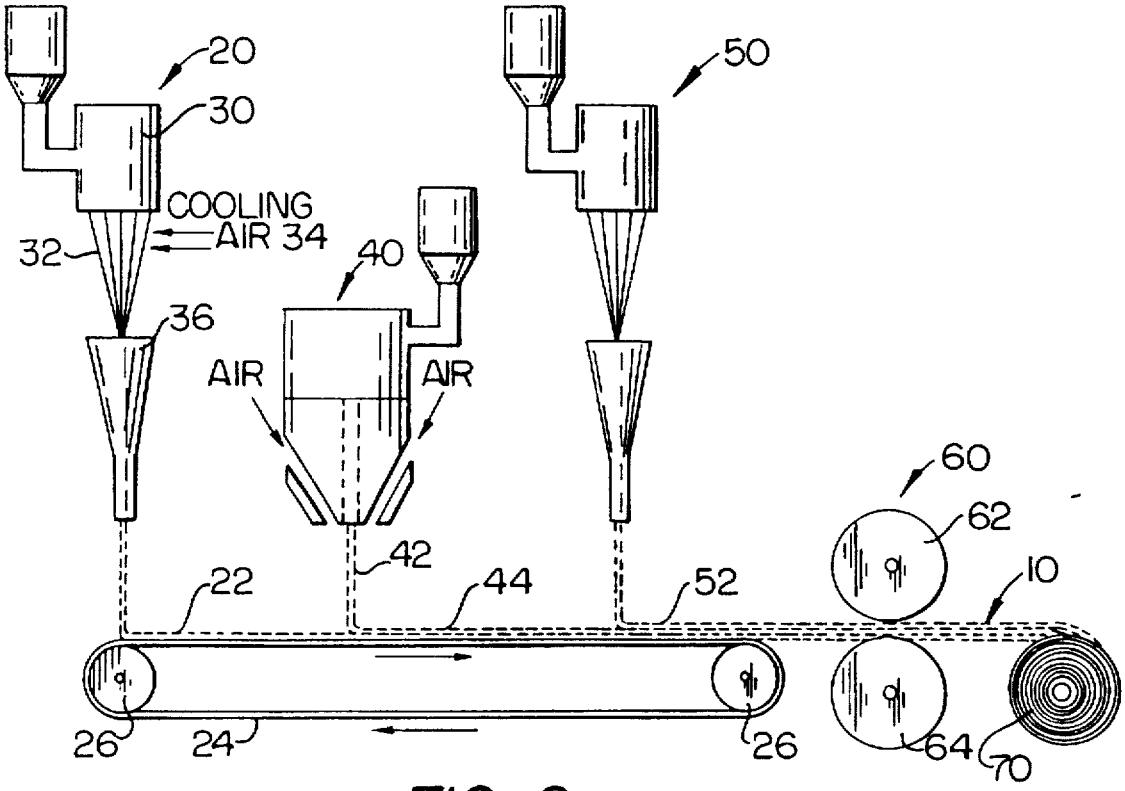
FIG. 2 schematically illustrates one method embodiment of the invention for forming a laminate nonwoven fabric of the invention.

Referring now to FIG. 2, an illustrative process for forming the laminate fabric 10 of the present invention is illustrated. A conventional spunbonding apparatus 20 forms a first spunbonded layer 22 of substantially continuous polypropylene polymer filaments. Web 22 is deposited onto forming screen 24 which is driven in a longitudinal direction by rolls 26.

The spunbonding process involves extruding a polymer through a generally linear die head or spinneret 30 for melt spinning substantially continuous filaments 32. The spinneret preferably produces the filaments in substantially equally spaced arrays and the die orifices are preferably from about 0.002 to about 0.040 inches in diameter.

As shown in FIG. 2, the substantially continuous filaments 32 are extruded from the spinneret 30 and quenched by a supply of cooling air 34. The filaments are directed to an attenuator 36 after they are quenched, and a supply of attenuation air is admitted therein. Although separate quench and attenuation zones are shown in the drawing, it will be apparent to the skilled artisan that the filaments can exit the spinneret 30 directly into the attenuator 36 where the filaments can be quenched, either by the supply of attenuation air or by a separate supply of quench air.

The attenuation air may be directed into the attenuator 36 by an air supply above the entrance end, by a vacuum located below a forming wire or by the use of eductors integrally formed in the attenuator. The air proceeds down the attenuator 36, which narrows in width in the direction away from the spinneret 30, creating a venturi effect and providing filament attenuation. The air and filaments exit the attenuator 36, and the filaments are collected on the collection screen 24. The attenuator 36 used in the spunbonding process may be of any suitable type known in the art, such as a slot draw apparatus or a tube type (Lurgi) apparatus.

After the spunbonded layer 22 is deposited onto screen 24, the web moves longitudinally beneath a conventional meltblowing apparatus 40. Meltblowing apparatus 40 forms a meltblown fibers stream 42 which is deposited on the surface of the spunbonded web 22 to form a spunbonded web/meltblown web structure 44. Meltblowing processes and apparatus are known to the skilled artisan and are disclosed, for example, in U.S. Pat. No. 3,849,241 to Buntin et al. and U.S. Pat. No. 4,048,364 to Harding et al.

In meltblowing, thermoplastic resin is fed into an extruder where it is melted and heated to the appropriate temperature required for fiber formation. The extruder feeds the molten resin to a special meltblowing die. The die arrangement is generally a plurality of linearally arranged small diameter capillaries. The resin emerges from the die orifices as molten threads or streams into high velocity converging streams of heated gas, usually air. The air attenuates the polymer streams and breaks the attenuated stream into a blast of fine fibers which are collected on a moving screen placed in front of the blast. As the fibers land on the screen, they entangle to form a cohesive web.

Spunbonded web/meltblown web structure 44 is next conveyed by forming screen 24 in the longitudinal direction beneath a second conventional spunbonding apparatus 50. The spunbonding apparatus 50 deposits a spunbonded polyethylene layer onto the structure 44 to thereby form a laminate structure 52 comprising a polypropylene spunbonded web/polypropylene meltblown web/polyethylene spunbonded web.

The three-layer laminate 52 is conveyed longitudinally as shown in FIG. 2 to a conventional thermal fusion station 60 to provide a composite bonded nonwoven fabric 10. The fusion station is constructed in a conventional manner as known to the skilled artisan, and advantageously includes cooperating embossing rolls 62 and 64, which may include at least one point roll, helical roll, and the like. Preferably, the layers are bonded together to provide a multiplicity of thermal bonds distributed throughout the laminate fabric. Bonding conditions, including the temperature and pressure of the bonding rolls, are known in the art for differing polymers. For the composite comprising a polypropylene spunbonded web/polypropylene meltblown web/polyethylene spunbonded web, the embossing rolls are preferably heated to a temperature between about 120° C. and about 130° C. The laminate is fed through the embossing rolls at a speed of about 3 to 300 meters per minute, and preferably a speed between about 5 and 150 meters per minute.

Although a thermal fusion station in the form of bonding rolls is illustrated in FIG. 2, other thermal treating stations such a ultrasonic, microwave or other RF treatment zones which are capable of bonding the fabric can be substituted for the bonding rolls of FIG. 2. Such conventional heating stations are known to those skilled in the art and are capable of effecting substantial thermal fusion of the nonwoven webs. In addition, other bonding techniques known in the art can be used, such as hydroentanglement of the fibers, needling, and the like. It is also possible to achieve bonding through the use of an appropriate bonding agent as is known in the art, singly or in combination with thermal fusion.

The resultant laminate fabric 10 exits the thermal fusion station and is wound up by conventional means on a roll 70.

The method illustrated in FIG. 2 is susceptible to numerous variations. For example, although the schematic illustration of FIG. 2 has been described as forming a spunbonded web directly during an in-line continuous process, it will be apparent that the spunbonded webs can be preformed and supplied as rolls of preformed webs. Similarly, although the meltblown web is shown as being formed directly on the spunbonded web, and the spunbonded web thereon, meltblown webs and spunbonded webs can be preformed and such preformed webs can be combined to form the laminate fabric, or can be passed through heating rolls for further consolidation and thereafter passed on to a spunbonded web or it can be stored in roll form and fed from a preformed roll onto the spunbonded layer. Similarly, the three-layer laminate can be formed and stored prior to embossing at embossing station.

Additionally, the polymers used in the present invention may be specifically engineered to provide or improve a desired property in the laminate. For example, any one of a variety of adhesive-promoting, or "tackifying" agents, such as ethylene vinyl acetate copolymers, may be added to the polymers used in the production of any of the webs of the laminate structure to improve inter-ply adhesion. Further, at least one of the webs may be treated with a treatment agent to render any one of a number of desired properties to the fabric, such as flame retardancy, hydrophilic properties, and the like.

The present invention will be further illustrated by the following non-limiting examples.

EXAMPLE 1

Polypropylene spunbonded webs and polyethylene spunbonded webs were prepared, and various properties of each were evaluated. The results set forth in Table 1 below demonstrate the improved softness of polyethylene spunbonded webs and improved abrasion resistance of polypropylene spunbonded webs.

TABLE 1

| Sample | A | B |
|---|---|---|
| Composition: | | |
| % polypropylene | 100 | 0 |
| % polyethylene | 0 | 100 |
| filament dia. (microns) | 17.5 | 20.9 |
| Basis weight (gsm)[1] | 23.1 | 25.2 |
| Loft @ 95 g/in$^2$ (mils)[2] | 9.8 | 9.0 |
| Fuzz (mg)[3] | 0.3 | 12.5 |
| Softness[4] | 30 | 75 |
| Strip Tensile (g/cm)[5] | | |
| CD | 557 | 139 |
| MD | 1626 | 757 |
| Peak Elongation (%) | | |
| CD | 90 | 116 |
| MD | 93 | 142 |
| TEA (in.g./in) | | |
| CD | 852 | 297 |
| MD | 2772 | 2222 |

[1]gsm—grams per square meter

[2]Loft was determined by measuring the distance between the top and the bottom surface of the fabric sheet while the sheet was under compression loading of 95 grams per square inch. The measurement is generally the average of 10 measurements.

[3]Fuzz is determined by repeatedly rubbing a soft elastomeric surface across the face of the fabric a constant number of times. The fiber abraded from the fabric surface is then weighed. Fuzz is reported as mg weight observed.

[4]Softness was evaluated by an organoleptic method wherein an expert panel compared the surface feel of Example Fabrics with that of controls. Results are reported as a softness score with higher values denoting a more pleasing hand. Each reported value is for a single fabric test sample, but reflects the input of several panel members.

TABLE 1-continued

| Sample | A | B |
|---|---|---|

[5]Tensile, Peak Elongation and TEA were evaluated by breaking a one inch by seven inch long sample generally following ASTM D1682-64, the one-inch cut strip test. The instrument cross-head speed was set at 5 inches per minute and the gauge length was set at 5 inches per minute. The Strip Tensile Strength, reported as grams per centimeter, is generally the average of at least 8 measurements. Peak Elongation is the percent increase in length noted at maximum tensile strength. TEA, Total Tensile Energy Absorption, is calculated from the area under the stress-strain curve generated during the Strip Tensile test.

EXAMPLE 2

A composite nonwoven fabric according to the invention was prepared as described below. A nonwoven web was formed of spunbonded polypropylene available from Exxon Chemical under the trade designation 3445. The filaments had a denier per filament of 3, and the spunbonded web of substantially continuous polypropylene filaments has a basis weight of about 20 gsm. A second nonwoven web was prepared by meltblowing polypropylene available from Exxon Chemical under the trade designation 3445G to give a fibrous web having a basis weight of about 12 gsm. A third nonwoven web was formed of spunbonded polyethylene available from Dow Chemical.

The webs were combined and pressed together to form a polypropylene spunbonded/polypropylene meltblown/polyethylene spunbonded composite laminate fabric. The composite laminate fabric was thereafter passed through the nip of a cooperating pair of textured and smooth embossing rolls. (Sample C).

To evaluate the improved aesthetic properties of the laminate fabrics of the invention, a second trilaminate fabric was prepared as described above, except that the polyethylene spunbonded web was substituted with a second polypropylene spunbonded web (Sample D). The softness and flexibility of both the trilaminate fabric in accordance with the invention and the comparative trilaminate fabric were determined, and the results are set forth below in Table 2.

TABLE 2

| Sample | C (invention) | D (comparative) |
|---|---|---|
| softness/flexibility (g)[1] | 45 | 81 |

[1]Softness and flexibility of the trilaminate fabrics were determined following INDA IST 90.3-92 Handle-O-Meter stiffness Test Procedure for Nonwoven Fabrics. In this test, the nonwoven to be tested is deformed through a restricted opening by a plunger, and the required force to deform the fabric is measured in grams.

The laminate fabrics of the invention exhibited good barrier and filtration properties and liquid repellency. In addition, the laminate fabrics of the invention exhibit high flexibility (i.e., ease of handling) and superior softness.

The foregoing example is illustrative of the present invention and is not to be construed as limiting thereof. The invention is defined by the following claims, with equivalents of the claims to be included therein.

That which is claimed is:

1. A liquid repellent nonwoven laminate barrier fabric, comprising:

a first nonwoven web of spunbonded substantially continuous thermoplastic filaments;

a second nonwoven web of spunbonded substantially continuous thermoplastic filaments, said second spunbonded fabric having different softness and flexibility properties as compared to said first spunbonded web; and a nonwoven web of meltblown microfibers sandwiched between and bonded to said first and second nonwoven spunbonded webs to form a unitary fabric structure having a combination of different softness and flexibility properties.

2. The nonwoven laminate fabric according to claim 1, wherein the softness differential between said first and second spunbonded nonwoven webs is at least about 25% as determined using IST90.3-92 test procedure.

3. The nonwoven laminate fabric according to claim 1, wherein the softness differential between said first and second spunbonded nonwoven webs is at least about 50% as determined using IST90.3-92 test procedure.

4. The nonwoven laminate fabric according to claim 1, wherein the flexibility differential between said first and second nonwoven spunbonded webs is at least about 25% as determined using IST90.3-92 test procedure.

5. The nonwoven laminate fabric according to claim 1, wherein the flexibility differential between said first and second nonwoven spunbonded webs is at least about 50% as determined using IST90.3-92 test procedure.

6. The nonwoven laminate fabric according to claim 1, wherein said first spunbunded web comprises substantially continuous polypropylene filaments, and wherein said second spunbonded web comprises substantially continuous polyethylene filaments.

7. The nonwoven laminate fabric according to claim 1, further comprising a multiplicity of thermal bonds bonding said first and second nonwoven spunbonded webs and said meltblown web together to form a coherent laminate fabric.

8. The nonwoven laminate fabric according to claim 6, wherein said laminate fabric exhibits a flexibility of about 45 grams, determined using standard test procedure IST90.3-92.

9. A nonwoven laminate fabric, comprising:

a first nonwoven web formed of spunbonded substantially continuous polypropylene filaments;

a second nonwoven web formed of spunbonded substantially continuous polyethylene filaments; and a third nonwoven web of meltblown polypropylene microfibers sandwiched between and bonded to said first and second nonwoven webs to form a composite nonwoven laminate fabric having differential softness and flexibility properties.

10. The laminate fabric according to claim 9 further comprising a multiplicity of thermal bonds bonding said first and second spunbonded nonwoven webs and said meltblown web together to form a coherent laminate fabric.

11. The nonwoven laminate fabric according to claim 10, wherein said laminate fabric exhibits at least about 25% increase in flexibility as compared to a polypropylene spunbonded/polypropylene meltblown/polypropylene spunbonded fabric of substantially the same basis weight.

12. A surgical gown constructed from a nonwoven fabric laminate comprising a first nonwoven web of spunbonded substantially continuous thermoplastic filaments; a second nonwoven web of spunbonded substantially continuous thermoplastic filaments, said second spunbonded fabric having different softness and flexibility properties as compared to said first spunbonded web; and a nonwoven web of meltblown microfibers sandwiched between and bonded to said first and second nonwoven spunbonded webs to form a unitary fabric structure having a combination of different softness and flexibility properties.

13. A surgical drape constructed from a nonwoven fabric laminate comprising a first nonwoven web of spunbonded substantially continuous thermoplastic filaments, a second nonwoven web of spunbonded substantially continuous thermoplastic filaments, said second spunbonded web having different softness properties as compared to said first spunbonded layer, and a nonwoven web of meltblown microfibers sandwiched between and bonded to said first and second nonwoven spunbonded webs to form a composite nonwoven fabric having a combination of different softness and flexibility properties.

14. A process for the manufacture of a nonwoven laminate fabric, the process comprising:

forming a layered fabric including a nonwoven web of thermoplastic microfine meltblown fibers sandwiched between opposing nonwoven webs formed of spunbonded substantially continuous filaments, said opposing spunbonded webs having different softness and flexibility properties; and bonding said opposing nonwoven spunbonded webs and said meltblown webs together to form a coherent laminate fabric having differential softness and flexibility properties.

15. The process according to claim 14, wherein the step of bonding said laminate fabric comprises thermally bonding said laminate fabric to form a multiplicity of discrete thermal bonds distributed throughout the fabric.

16. The process according to claim 14, wherein at least one of said spunbonded webs is a spunbonded web formed of substantially continuous polypropylene filaments, and wherein the other of said spunbonded webs is a spunbonded web formed of substantially continuous polyethylene filaments.

17. The process according to claim 16, wherein said meltblown web comprises a plurality of polypropylene meltblown microfibers.

* * * * *